United States Patent [19]

Larsen

[11] Patent Number: 5,035,127

[45] Date of Patent: Jul. 30, 1991

[54] LOCK ARRANGEMENT FOR CONTAINERS

[75] Inventor: Allan R. Larsen, Graested, Denmark

[73] Assignee: Servial CC ApS, Denmark

[21] Appl. No.: 414,243

[22] Filed: Sep. 29, 1989

[51] Int. Cl.[5] ..... E05B 73/00

[52] U.S. Cl. ..... 70/56; 70/417

[58] Field of Search ..... 70/58, 54, 55, 56, 417

[56] References Cited

U.S. PATENT DOCUMENTS

| | | | |
|---|---|---|---|
| 2,166,660 | 7/1939 | Handshy et al. . | |
| 3,736,016 | 5/1973 | Garvey et al. . | |
| 3,744,280 | 7/1973 | Brown, Jr. et al. . | |
| 4,106,135 | 8/1978 | Dohanyas . | |
| 4,106,315 | 8/1978 | Dohanyos . | |
| 4,269,048 | 5/1981 | McDorman | 70/13 |
| 4,324,426 | 4/1982 | Michelson . | |
| 4,566,296 | 1/1986 | Kochakis | 70/56 |
| 4,581,907 | 4/1986 | Eberly . | |

FOREIGN PATENT DOCUMENTS

| | | |
|---|---|---|
| 64533 | 10/1944 | Denmark . |
| 103308 | 2/1964 | Norway . |

*Primary Examiner*—Robert L. Wolfe

*Attorney, Agent, or Firm*—Bernard, Rothwell & Brown

[57] ABSTRACT

A lock arrangement for containers comprising a latch with a crossbar and a counterpart, the crossbar and the counterpart being equipped with lock members provided with holes. The lock members are locked together by means of a padlock. When the lock arrangement is shut, the lock members are inside a housing mounted on the crossbar or the counterpart. The housing is shaped and arranged in such a way that it tightly encloses the padlock and the lock members when the padlock provided with a straight shackle is in its locked position. The housing and the lock members are furthermore provided such that the padlock is insertable in the housing via an opening therein by a rectilinear movement in at least two directions perpendicular to each other. The crossbar and the counterpart are fastened to the container by means of safety fastening means, such as bolts, the heads of which being on the same level as the crossbar and/or the counterpart. This results in a simple and burglar-proof lock arrangement for containers. The lock arrangement is permanently fixed to the container.

13 Claims, 2 Drawing Sheets

LOCK ARRANGEMENT FOR CONTAINERS

Field of the Invention

The invention relates to a lock arrangement for containers comprising a latch with a crossbar and a counterpart, the crossbar and the counterpart being equipped with lock members provided with holes, said lock members being locked together by means of a padlock.

BACKGROUND ART

Swedish published patent application no. 441.820 discloses a lock arrangement for a container comprising a bar. The arrangement is provided with fixing means inserted in the openings of the braces on the edges of the container. The arrangement is provided with a lock handle connected with one of the fixing means and rotatably therein. In its locked position the lock handle is enclosed by a protective shield. The object of this shield is to reduce the risk of the lock being forced open. The protective shield is, however, unsatisfactory, as a burglar with suitable equipment is easily able to reach the vital parts, especially the shackle of the padlock. Furthermore it is disadvantageous that the entire lock arrangement has to be removed for obtaining access to the container. Moreover, the arrangement is very heavy and difficult to handle. It can also be used for different containers, since it is not especially adapted to one container.

U.S. Pat. No. 4,500,123 discloses a door lock arrangement for e.g. the back door of a truck or a van. The lock arrangement comprises two tube-shaped parts, each fastened to one half of a double door. The end of one tube-shaped part is provided with a box-shaped part. When the lock is to be shut, a long tube is inserted in the two tube-shaped parts, the length of said tube corresponding to the total length of the two tube-shaped parts. The long tube is provided with a plate fitting in a groove in the box-shaped part. The plate has a hole through which the shackle of a padlock is insertable. When the lock is to be shut and the plate is positioned in the groove of the box-shaped part, the padlock is inserted in the box-shaped part and locked. The padlock is now positioned inside the box-shaped part and thus protected against cutting-off and other ways of being forced open. Furthermore the inside of the long tube is provided with a freely rotatable inner tube. The object of the inner tube is to render it more difficult to cut through the long tube. The disadvantage of this door lock arrangement lies in the padlock not being tightly enclosed by the box-shaped part, and the long tube having to be removed entirely from the lock arrangement before the opening of the door. The remaining parts are, however, permanently mounted on the door. A further disadvantage is that although they are secured, the heads of the bolts are accessible from outside, e.g. for a crowbar or the like.

The object of the invention is to provide a lock arrangement of the above type not only reducing the above disadvantages but also ensuring a considerably improved protection against burglary.

SUMMARY OF THE INVENTION

According to the invention, when the lock arrangement is shut, the lock members are inside a housing mounted on the crossbar or the counterpart, said housing being shaped and arranged in such a way that it tightly encloses the padlock and the lock members, when the padlock provided with a straight shackle is in its locked position, and the housing and the lock members are furthermore provided such that the padlock is insertable in the housing via an opening therein by a rectilinear movement in at least two directions perpendicular to each other, and the crossbar and the counterpart are fastened to the container by means of safety fastening means, such as bolts, the heads of which being on the same level as or flush with the crossbar and/or the counterpart. Since the lock members and the shackle of the padlock are tightly enclosed by the housing when the lock arrangement is shut, it is virtually impossible to obtain access to these vital parts by e.g. a saw or a crowbar. When the fastening means are secured a burglar is not tempted to try to force the lock arrangement by removing said fastening means. All part are fastened to the container, thus avoiding various forms of loose rods. A further advantage of the inventive arrangement is that all parts are permanently connected with the container, and only the lock itself is removable when the lock arrangement is not in use.

According to the invention the housing is box-shaped and completely closed off at four of the six sides, partly closed off on the fifth side and open on the sixth side. Consequently the lock is accessible only from one side, rendering it difficult for a burglar to obtain access to the vital parts of the lock by means of various tools.

In a preferred embodiment of the inventive lock arrangement the lock member in the housing is fastened to two of the sides of the housing and to an edge of the fifth side. This results in a substantial part of the padlock being situated inside the housing and thus completely inaccessible when the padlock is in its locked position.

In a further preferred embodiment of the inventive lock arrangement the lock member mounted in the housing forms a chamber therein, said chamber being closed off on five sides, apart from the hole in the lock member, while the sixth side of the chamber is open, thus increasing the inaccessibility.

According to the invention it is advantageous that the first insertion direction of the padlock is parallel to but not coinciding with the axis of the hole through the lock members.

The inventive lock members are made of thick plate-shaped blanks, and the total thickness of the blanks is slightly less than the largest width the padlock is able to bridge. This renders it very difficult to twist the lock apart.

In yet another preferred embodiment of the invention the fastening means include bolts retainable during the lock arrangement being mounted on the container, e.g. by means of the bolt having a hexagonal socket at the end opposite the head. As a result it is impossible to get a grip on the heads of the bolts from outside by using various types of tools.

In a further embodiment of the invention the fastening means in form of bolts are secured against cutting off by means of sleeves arranged around the shanks of the bolts, and that the sleeves are freely rotatable, although the bolts are secured, and that the sleeves are countersunk in the spacers, and the counterpart is an integral part of the spacers. When a person attempts to cut through the shank of the bolt by either cutting down between the parts of the lock arrangement or by cutting said parts off, the sleeve only rotates, thus preventing cutting-off of the bolts.

In another embodiment of the invention the sleeves are of hardened steel or of sintered hard metal. Thus the bolts are manufactured from inexpensive materials, while the sleeves are extremely hard. Small round articles of even thickness are easily manufactured from extremely hard materials.

In a last embodiment of the invention the padlock is of substantially rectangular shape with an aperture in the middle, and the straight shackle substantially forms one of the four sides of the padlock, ensuring a better hold of the lock.

BRIEF DESCRIPTION OF THE DRAWINGS

The invention is described in greater detail below and with reference to the accompanying drawings, in which.

DETAILED DESCRIPTION OF THE INVENTION

Figure 1:
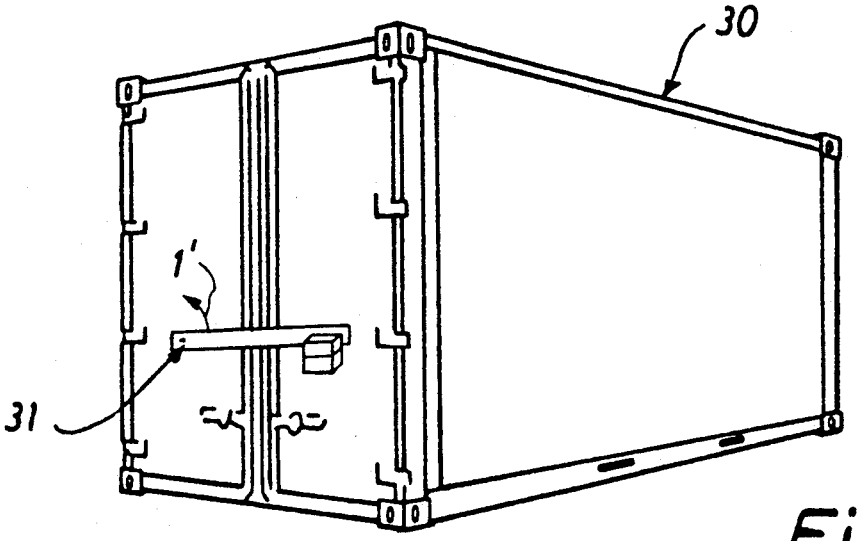
FIG. 1 illustrates a container with a mounted, inventive lock arrangement.

FIG. 1 illustrates a container having the general reference numeral 30 and comprising a lock arrangement having the general reference numeral 31.

Figure 2:
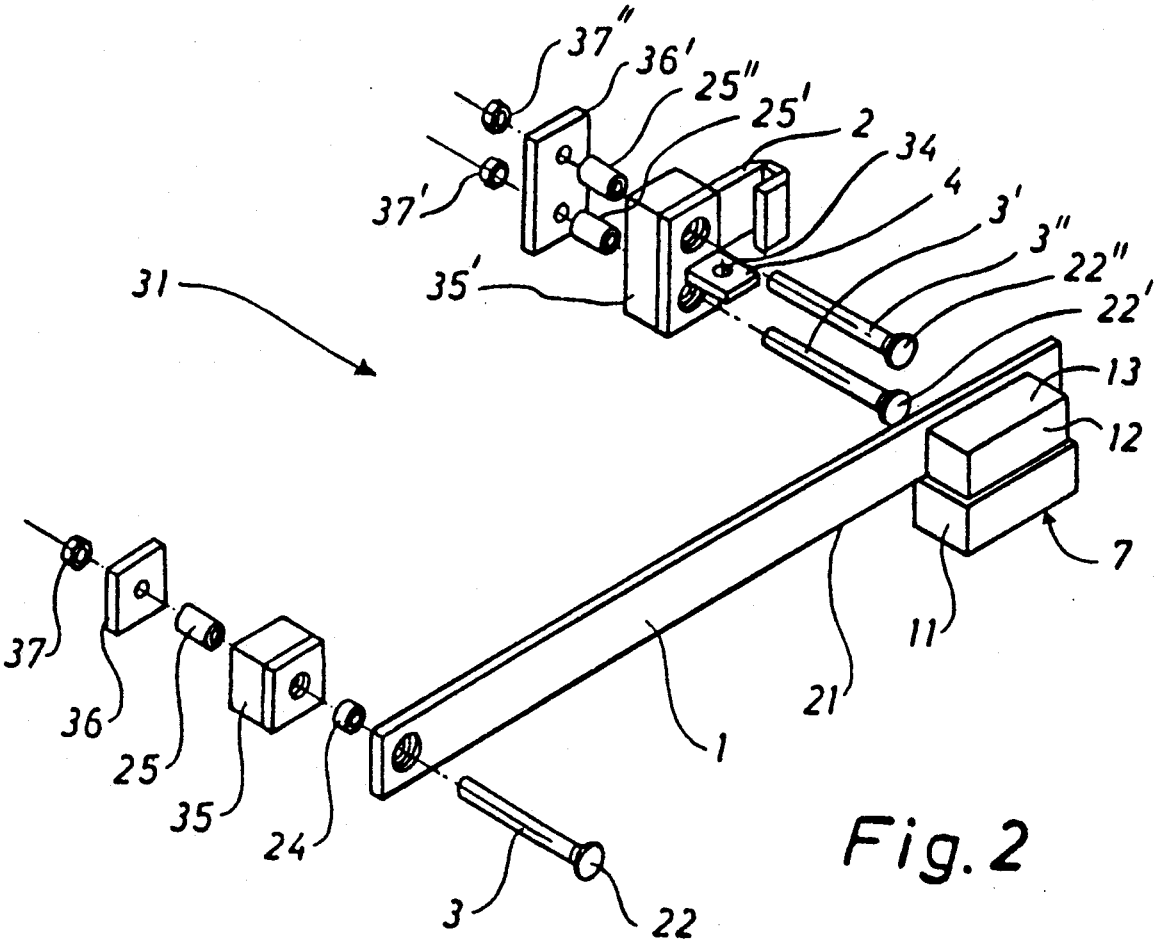
FIG. 2 is a perspective view of an inventive embodiment.

The lock arrangement of FIG. 2 is a latch comprising a crossbar 1 and a counterpart 2 wherein the crossbar 1, when unlocked, can be rotated as shown at 1' to release the doors of the container. The crossbar 1 is bolted to the container 30 by fastening means, such as bolts 3, while the counterpart 2 is secured by bolts 3' and 3. The bolt 3 has a head 22 fitting into a recess in the crossbar 1, while the bolts 3' and 3'' have heads 22' and 22'' fitting into corresponding recesses in the counterpart 2. The outermost part of each head 22, 22' and 22'' is on the same level as the outermost part of the crossbar 1. The bolts 3, 3' and 3'' extend through different types of spacers 35 and 35' and counterpiece 36 into corresponding holes in the container 30. The bolts 3, 3' and 3'' are then secured with nuts 37, 37' and 37''. Sleeves 24 and 25 are inserted in the spacer 35 and between the crossbar 1 and the spacer 35 while sleeves 25' and 25'' are inserted in the spacer 35'. The sleeves 24, 25, 25' and 25'' are countersunk in the spacers. The counterpart 2 is an integral part of the spacer 35' and provided with a hook-shaped part. The end of the bolts 3, 3' and 3'' opposite the head 22, have e.g. a hexagonal socket or a thread or a simple hole, so that the bolt is retainable inside the container 30, when the bolt is tightened or loosened. A lock member 4 with a through hole 34 is fastened to the counterpart 2. The lock member 4 with the through hole 34 consists of a plate welded to the counterpart 2. A second lock member 5, FIG. 4, with a through hole 34' is positioned inside the housing 7 and welded to the crossbar 1. The housing has the shape of a 6-sided box with the sides 11, 12 and 13 visible in FIG. 2. The fifth side is substantially the crossbar 1. The end of the housing 7 farthest away from the upper side 13 is reinforced with double plates.

Figure 3:
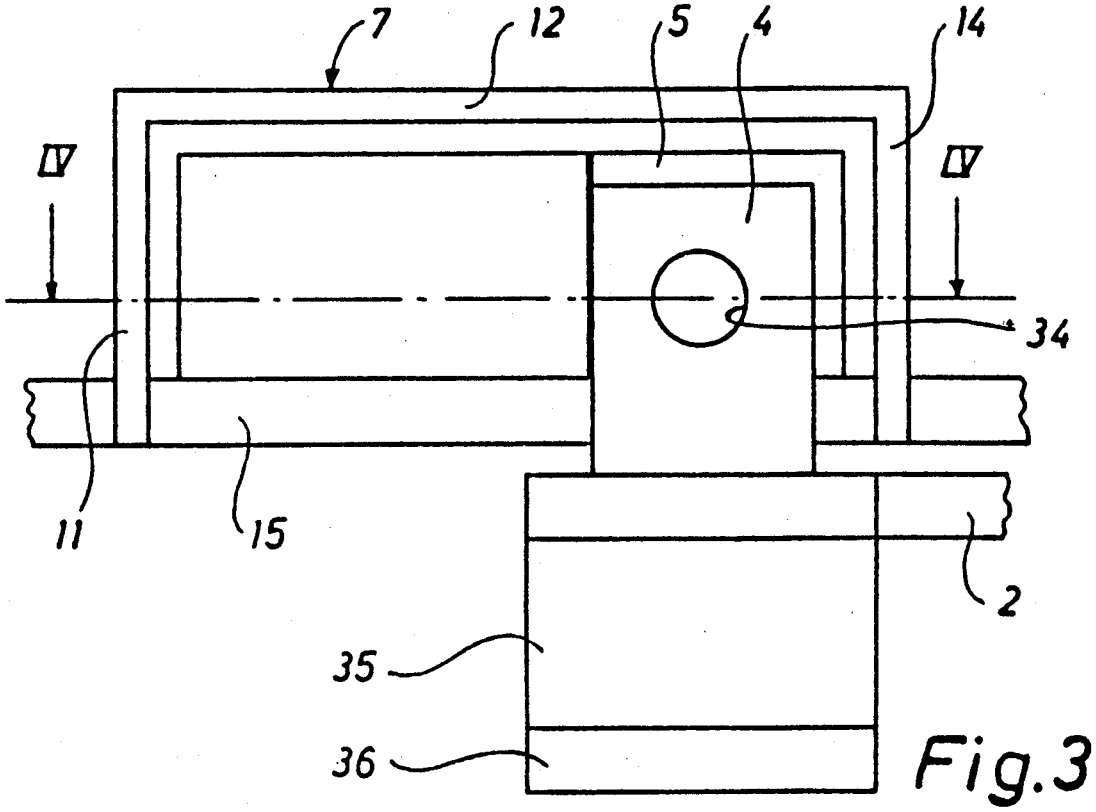
FIG. 3 is a bottom view of the housing of the lock arrangement.

FIG. 3 is a bottom view of the housing 7. Sides 11, 12, 14 and 15 of the housing 7 are visible. The sixth side 16 is actually open, as it is the side allowing a view into the inside of the housing 7. The lock member 4 fastened to the counterpart 2 is visible in the inside of the housing 7. The lock member 4 registers with the second lock member 5 fastened to the sides 12, 14 and 15 inside the housing.

Figure 4:
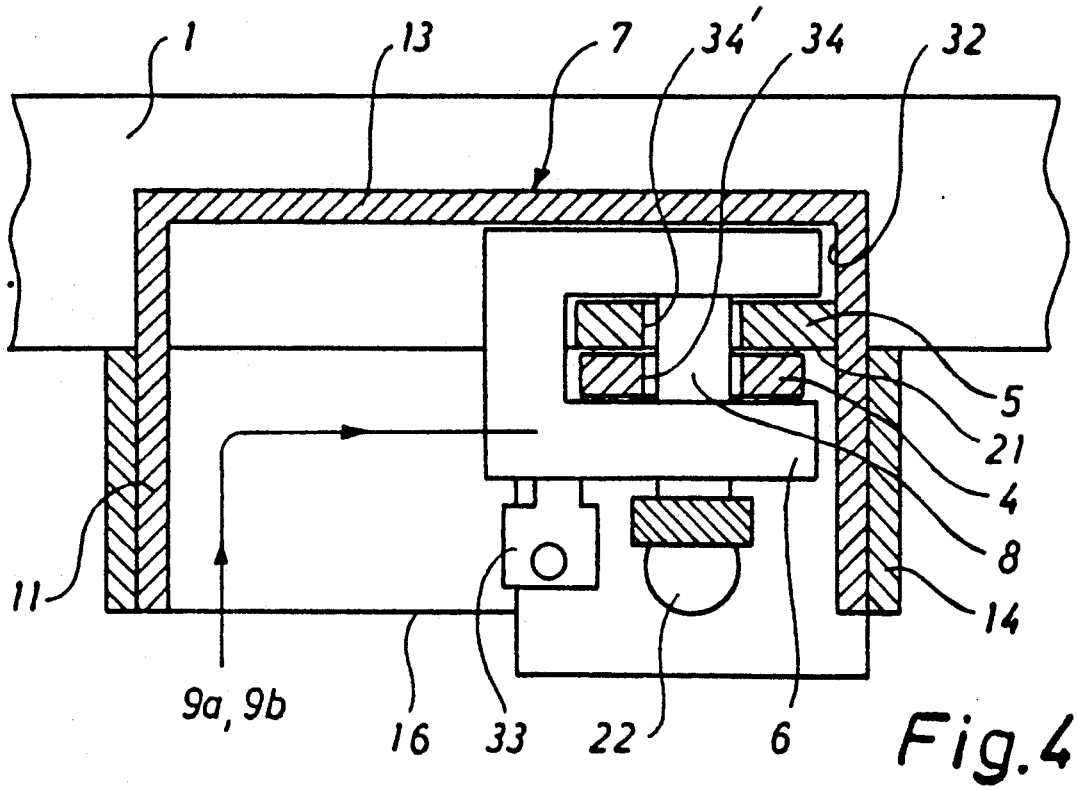
FIG. 4 is a sectional view along the line IV—IV of FIG. 3.

FIG. 4 is a sectional view of the housing 7 along the line IV—IV of FIG. 3. A padlock 6 with a straight shackle 8 is arranged in the housing. One end of the shackle 8 is knurled. The sides 11, 13, 14, and 16 of the housing 7 surround the padlock 6. The padlock is lockable by means of a key 33. The shackle 8 in the padlock 6 is displaceable through the holes 34 in the two lock members 4 and 5. The lock member 5 fastened inside the housing 7 is fastened parallel to an edge 21 of the fifth side, thus forming a chamber 32. The fifth side 15 is substantially formed by the crossbar 1. When the padlock 6 is to be inserted in the housing 7, it has to be moved along two directions **9*a*, 9*b*. The first part of the movement, in the direction 9*a*, is perpendicular to the crossbar 1, the subsequent movement 9*b* is substantially parallel to said crossbar. When the padlock 6 is in place so that it grips around the lock members 4 and 5 the shackle 8 is inserted through the holes 34 of the lock members 4, 5 and the key 33** is turned and removed. Consequently the padlock and thus the lock arrangement are locked. Owing to the difficulties connected with obtaining access to the central lock parts the lock arrangement is well secured against burglary.

The invention is not restricted to the above embodiments but can be modified in many ways, without thereby deviating from the scope of the invention. The housing can e.g. have curved sides, when this is more suitable for a given type of padlock. The sleeves may be made of granular material, and various parts of the lock arrangement can be made of special materials, such as plastics or ceramics, and the parts can be through-hardened, case hardened etc.

I claim:

1. A lock arrangement for containers comprising a crossbar and a counterpart, the crossbar and/or the counterpart being equipped with at least one lock member provided with a hole, a padlock with a straight shackle for insertion through the hole or holes of said lock member or members to lock said crossbar and counterpart together by means of the padlock, a housing mounted on the crossbar or the counterpart for surrounding the lock member or members, said housing being shaped and arranged in such a way that it tightly encloses the padlock and the lock member or members when the padlock and the straight shackle are in their locked position, the housing and the lock member or members furthermore being such that the padlock is insertable in the housing via an opening therein by a rectilinear movement in at least two directions perpendicular to each other, and the crossbar and the counterpart being fastened to the container by means of burglar-proof fastening means.

2. A lock arrangement as in claim 1, wherein the housing is box-shaped and completely closed off at four of the six sides, partly closed off on the fifth side and open on the sixth side.

3. A lock arrangement as in claim 2, wherein the lock member or members comprise a lock member in the housing fastened to two of the sides of the housing and to an edge of the fifth side.

4. A lock arrangement as in claim 1, wherein the lock member or members comprise a lock member mounted in the housing and forming a chamber therein, said chamber being closed off on five sides, apart from the hole in the lock member in the housing, while the sixth side of the chamber is open.

5. A lock arrangement as in claim 1, wherein the first insertion direction of the padlock is parallel to but not coinciding with the axis of the hole through the lock member or members.

6. A lock arrangement as in claim 1, 2, 3, or 4, wherein the lock member or members comprise two lock members made of thick plate-shaped blanks and mounted, respectively, on the cross bar and the counterpart, and the total thickness of the blanks is slightly less than the largest width the padlock is able to bridge.

7. A lock arrangement as in claim 1, wherein the fastening means include bolts mounted on the container.

8. A lock arrangement as in claim 7, wherein the bolts are secured against cutting off by means of spacers and sleeves arranged around the shanks of the bolts, the sleeves being freely rotatable although the bolts are secured, the sleeves being countersunk in the spacers, and the counterpart being an integral part of one of the spacers.

9. A lock arrangement as in claim 8, wherein the sleeves are of hardened steel or of sintered hard metal.

10. A lock arrangement as in claim 1, wherein the padlock is of substantially rectangular shape with an aperture in the middle, and the straight shackle substantially forms one of the four sides of the padlock.

11. A lock arrangement for containers comprising a latch with a crossbar and a counterpart, the crossbar and/or the counterpart being equipped with respective lock members each provided with a hole, a padlock with a straight shackle for insertion through the holes of said lock members to lock said crossbar and counterpart together by means of the padlock, a housing mounted on the crossbar or the counterpart for surrounding the lock members, said housing being shaped and arranged in such a way that it tightly encloses the padlock and the lock members when the padlock and the straight shackle are in their locked position, the housing and the lock members furthermore being such that the padlock is insertable in the housing via an opening therein by a rectilinear movement in at least two directions perpendicular to each other, and the crossbar and the counterpart being fastened to the container by means of burglar-proof fastening means.

12. A lock arrangement as in claim 1 or 11, wherein the burglar-proof fastening means comprises bolts having heads which are flush with the crossbar and/or counter part.

13. A lock arrangement as in claim 12 wherein the bolts have hexagonal sockets at the ends opposite the heads.

* * * * *

UNITED STATES PATENT AND TRADEMARK OFFICE

CERTIFICATE OF CORRECTION

PATENT NO. : 5,035,127

DATED : July 30, 1991

INVENTOR(S) : Allan Ralf Larsen

It is certified that error appears in the above-identified patent and that said Letters Patent is hereby corrected as shown below:

In Col. 3, line 35, delete "3′ and 3" and insert therefor --3′ and 3"--.

In Col. 3, line 42, delete "and counterpiece 36" and insert therefor --and counterpieces 36 and 36′--.

Signed and Sealed this

Third Day of August, 1993

Michael K. Kirk

*Attest:*

MICHAEL K. KIRK

*Attesting Officer*

*Acting Commissioner of Patents and Trademarks*